US012336678B2

(12) United States Patent
Dunaway et al.

(10) Patent No.: US 12,336,678 B2
(45) Date of Patent: Jun. 24, 2025

(54) SYSTEM AND METHOD FOR IMPROVING CLEANING PERFORMANCE OF A DISHWASHING APPLIANCE

(71) Applicant: Haier US Appliance Solutions, Inc., Wilmington, DE (US)

(72) Inventors: Logan Chayse Dunaway, Greenville, IN (US); Duwayne Jacob Drexler, Shepherdsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/470,934

(22) Filed: Sep. 20, 2023

(65) Prior Publication Data

US 2025/0089978 A1 Mar. 20, 2025

(51) Int. Cl.
*A47L 15/00* (2006.01)
*A47L 15/42* (2006.01)

(52) U.S. Cl.
CPC ..... *A47L 15/0057* (2013.01); *A47L 15/0063* (2013.01); *A47L 15/4206* (2013.01); *A47L 15/4208* (2013.01); *A47L 2401/34* (2013.01); *A47L 2501/34* (2013.01)

(58) Field of Classification Search
CPC ..... A47L 15/0057; A47L 15/0039; A47L 15/4206; A47L 15/4208; A47L 2401/34; A47L 2501/34; D06F 33/43; D06F 33/69
See application file for complete search history.

(56) References Cited

U.S. PATENT DOCUMENTS 5,097,855 A 3/1992 Martinsson et al.
8,007,597 B2 8/2011 Beaudet et al.
2012/0291821 A1* 11/2012 Buddharaju ..... A47L 15/4208 134/109
2013/0319458 A1* 12/2013 Lim ..... A47L 15/13 134/1
2013/0319477 A1* 12/2013 Lim ..... A47L 15/4206 134/104.1
2015/0265128 A1* 9/2015 Pers ..... A47L 15/0049 134/18

FOREIGN PATENT DOCUMENTS

CN 109833012 A 6/2019
JP 6149251 B2 6/2017
KR 20180024263 A 3/2018
WO WO-2014089425 A1 * 6/2014 ..... A47L 15/0002
WO WO-2018153472 A1 * 8/2018 ..... A47L 15/0023
WO WO2022272008 A1 12/2022

* cited by examiner

*Primary Examiner* — Sharidan Carrillo
(74) *Attorney, Agent, or Firm* — Dority & Manning, P.A.

(57) ABSTRACT

A method for improving cleaning performance of a dishwashing appliance includes implementing, via a computer application, a filter cleaning process for a filter assembly of the dishwashing appliance. The filter assembly is positioned at least partially in a sump in a bottom wall of the dishwashing appliance. The filter cleaning process includes prompting a user to remove the filter assembly from the dishwashing appliance. Further, the filter cleaning process includes initiating the dishwashing appliance to fill and drain the dishwashing appliance for a predetermined time period to flush the dishwashing appliance of residual particles remaining in the sump. Moreover, once the filling and draining is complete, the filter cleaning process includes prompting the user to reinstall the filter assembly in the dishwashing appliance.

14 Claims, 7 Drawing Sheets

SYSTEM AND METHOD FOR IMPROVING CLEANING PERFORMANCE OF A DISHWASHING APPLIANCE

FIELD

The present disclosure relates generally to dishwashing appliances, and more particularly, to systems and methods for improving cleaning performance of a dishwashing appliance that includes residual pump flushing.

BACKGROUND

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. Dishwashing appliances are also typically equipped with one or more pumps, such as a circulation pump or a drain pump, for directing or motivating wash liquid from the sump to, e.g., the spray assemblies or an area outside of the dishwashing appliance.

Dishwashing appliances also include a door for providing selective access to the wash chamber. In order to provide a user with information regarding the dishwashing appliance operation, e.g., such as a status of an operating cycle or an indication that a cycle is complete, status indicators are often positioned on the outer door of the appliance such that they are visible to a user of the appliance. Additionally, in order to provide a user with an interface to set or adjust the operational settings for the dishwashing appliance, a user interface panel is often positioned on the top of the door of the dishwashing appliance.

Many dishwashing appliances are equipped with one or more filters for filtering the water and catching food particles as the appliance runs a wash cycle. Oftentimes, the filter is located below the lower dish rack in the bottom of the dishwashing appliance. Periodically, the filter needs to be de-clogged and cleaned. However, not all users of dishwashing appliances are aware of when to, if at all, change their filters. Further, even if a user periodically cleans the filter, the user typically neglects a thorough filter cleaning process that removes residual sediments that reside at the bottom of the sump once the filter is removed. If not removed, these sediments remain in the sump even after the filter is reinstalled. To the user, this can result in a lack of filter quality perception and a perception of dirtiness associated with the dishwashing appliance. This could even prompt the user to question the importance of cleaning the filter altogether.

Accordingly, features and methods for filter cleaning and residual pump flushing that address the aforementioned issues would be useful.

BRIEF DESCRIPTION

Aspects and advantages of the invention will be set forth in part in the following description, or may be obvious from the description, or may be learned through practice of the invention.

In an aspect, the present disclosure is directed to a method for improving cleaning performance of a dishwashing appliance. The method includes implementing, via a computer application, a filter cleaning process for a filter assembly of the dishwashing appliance. The filter assembly is positioned at least partially in a sump in a bottom wall of the dishwashing appliance. The filter cleaning process includes, for example, prompting a user to remove the filter assembly from the dishwashing appliance, initiating the dishwashing appliance to fill and drain the dishwashing appliance for a predetermined time period to flush the dishwashing appliance of residual particles remaining in the sump, and once the filling and draining is complete, prompting the user to reinstall the filter assembly in the dishwashing appliance.

In another aspect, the present disclosure is directed to a system for improving cleaning performance of a dishwashing appliance. The system includes a user interface configured to run a computer application thereon. The computer application is configured to implement a filter cleaning process for a filter assembly of the dishwashing appliance. The filter assembly is positioned at least partially in a sump in a bottom wall of the dishwashing appliance. The filter cleaning process includes, for example, prompting a user to remove the filter assembly from the dishwashing appliance, initiating the dishwashing appliance to fill and drain the dishwashing appliance for a predetermined time period to flush the dishwashing appliance of residual particles remaining in the sump, and once the filling and draining is complete, prompting the user to reinstall the filter assembly in the dishwashing appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
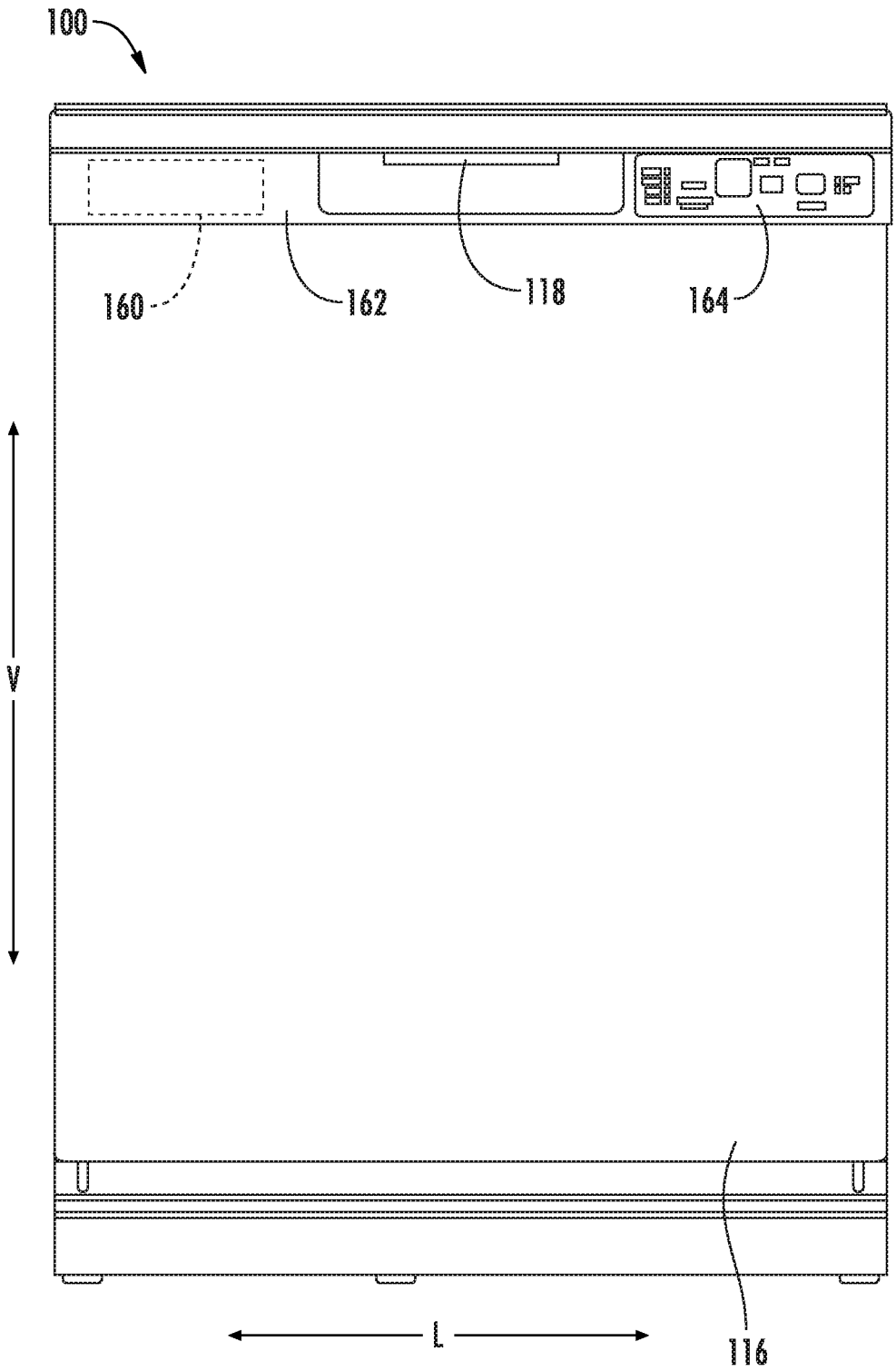
FIG. 1 provides a front view of a dishwashing appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is used to refer to an overall operation of the dishwashing appliance which may include two or more distinct phases. The term "wash phase" is intended to refer to one or more periods of time during which a dishwashing appliance operates while containing the articles to be washed and uses a wash liquid (e.g., water, detergent, or wash additive) and may be a portion of the wash cycle, such as a beginning or early portion of the wash cycle. The term "rinse phase" is intended to refer to one or more periods of time during which the dishwashing appliance operates to remove residual soil, detergents, and other undesirable elements that were retained by the articles after completion of the wash phase and may be a portion of the wash cycle, such as an intermediate portion of the wash cycle. The term "drain phase" is intended to refer to one or more periods of time during which the dishwashing appliance operates to discharge soiled water from the dishwashing appliance and may be a portion of the wash cycle, such as a later portion of the wash cycle. The term "wash liquid" refers to a liquid used for washing or rinsing the articles that is typically made up of water and may include additives, such as detergent or other treatments (e.g., rinse aid).

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
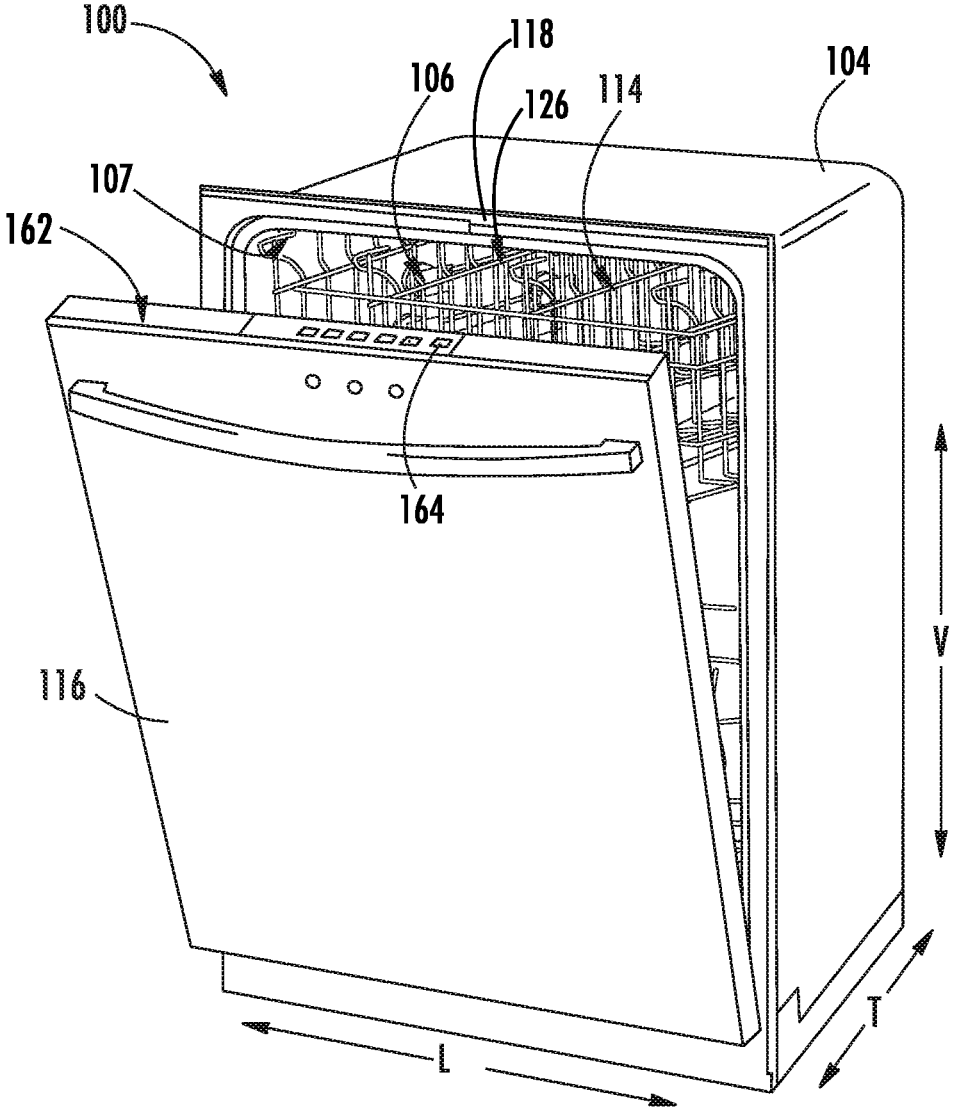
FIG. 2 provides a perspective view of a dishwashing appliance with a door in an intermediate position according to one or more exemplary embodiments of the present disclosure.
Figure 3:
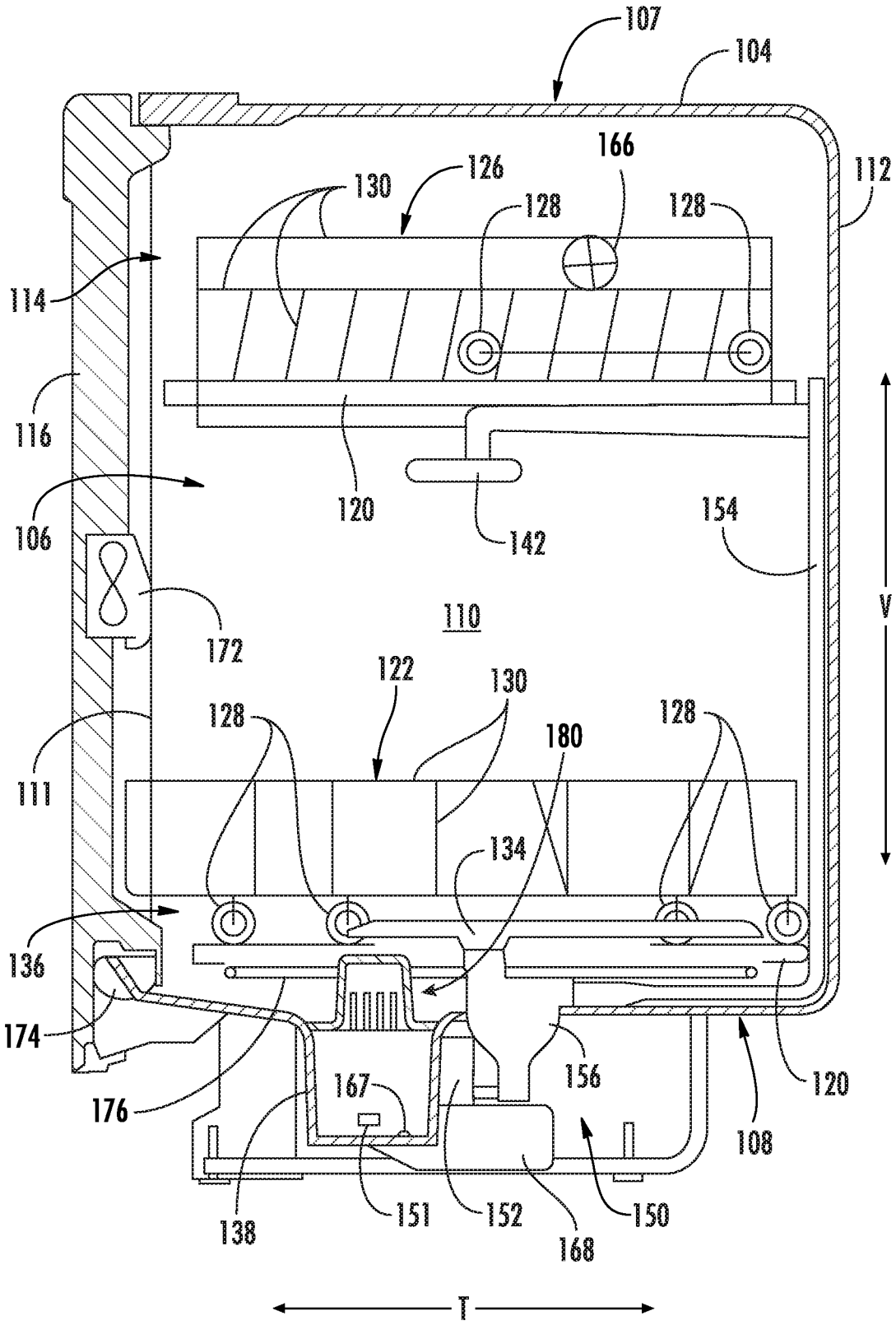
FIG. 3 provides a side, cross section view of a dishwashing appliance, such as the dishwashing appliance of FIG. 1 or FIG. 2, according to one or more exemplary embodiments of the present disclosure.

Referring now to the figures, FIGS. 1 through 3 depict a dishwashing appliance 100 that may be configured according to one or more exemplary aspects of the present disclosure. Generally, the dishwashing appliance 100 defines a vertical direction V, a lateral direction L, and a transverse direction T. Each of the vertical direction V, lateral direction L, and transverse direction T are mutually perpendicular to one another and form an orthogonal direction system. The dishwashing appliance 100 may include a tub 104 that defines a wash chamber 106 therein. As shown in FIG. 3, the tub 104 extends between a top 107 and a bottom 108 along the vertical direction V, between a pair of side walls 110 along the lateral direction L, and between a front side 111 and a rear side 112 along the transverse direction T.

In some embodiments, the tub 104 includes a front opening 114 at the front side 111. Additionally, in some embodiments, the dishwashing appliance 100 includes a door 116 at the front opening 114. The door 116 may, for example, be coupled to the tub 104 by a hinge 174 (FIGS. 3 and 4) at its bottom for movement between a normally closed vertical position (FIGS. 1 and 3), wherein the wash chamber 106 is sealed shut for washing operation, and an open position for loading and unloading of articles from the dishwashing appliance 100. A door closure mechanism or assembly 118, e.g., a latch, may be provided to lock and unlock the door 116 for accessing and sealing the wash chamber 106.

In an embodiment, the tub side walls 110 accommodate a plurality of rack assemblies. For instance, guide rails 120 may be mounted to the side walls 110 for supporting a lower rack assembly 122 and an upper rack assembly 126. In some such embodiments, the upper rack assembly 126 is positioned at a top portion of the wash chamber 106 above the lower rack assembly 122 along the vertical direction V.

Generally, each rack assembly 122, 126 may be adapted for movement between an extended loading position (not shown) in which the rack is substantially positioned outside the wash chamber 106, and a retracted position (FIG. 3) in which the rack is located inside the wash chamber 106. In some embodiments, movement is facilitated, for instance, by rollers 128 mounted onto rack assemblies 122, 126, respectively.

Although the guide rails 120 and the rollers 128 are illustrated herein as facilitating movement of the respective rack assemblies 122, 126, it should be appreciated that any suitable sliding mechanism or member may be used according to alternative embodiments.

In optional embodiments, some or all of the rack assemblies 122, 126 are fabricated into lattice structures including a plurality of wires or elongated members 130 (for clarity of illustration, not all elongated members making up rack assemblies 122, 126 are shown). In this regard, rack assemblies 122, 126 are generally configured for supporting articles within wash chamber 106 while allowing a flow of wash liquid to reach and impinge on those articles (e.g., during a cleaning or rinsing phase of the wash cycle). According to additional or alternative embodiments, a silverware basket (not shown) may be removably attached to a rack assembly (e.g., lower rack assembly 122), for placement of silverware, utensils, and the like, that are otherwise too small to be accommodated by the rack assembly.

Generally, the dishwashing appliance 100 includes one or more spray assemblies for urging a flow of fluid (e.g., wash liquid) onto the articles placed within the wash chamber 106. In exemplary embodiments, the dishwashing appliance 100 includes a lower spray arm assembly 134 disposed in a lower region 136 of the wash chamber 106 and above a sump 138 so as to rotate in relatively close proximity to lower rack assembly 122. In this regard, the lower spray arm assembly 134 may generally be configured for urging a flow of wash liquid up through the lower rack assembly 122.

In some embodiments, an upper spray assembly 142 is located proximate to and, e.g., below, upper rack assembly 126 along the vertical direction V. In this manner, the upper spray assembly 142 may be generally configured for urging of wash liquid up through the upper rack assembly 126.

The various spray assemblies and manifolds described herein may be part of a fluid distribution system or fluid circulation assembly 150 for circulating wash liquid in the tub 104. In certain embodiments, the fluid circulation assembly 150 includes a circulation pump 152 for circulating wash liquid in tub 104. The circulation pump 152 may be mounted to the sump 138 and in fluid communication with the sump 138 through a circulation outlet 151 from the sump 138.

When assembled, the circulation pump 152 may be in fluid communication with an external water supply line (not shown) and the sump 138. A water inlet valve (not shown) can be positioned between the external water supply line and the circulation pump 152 (e.g., to selectively allow water to flow from the external water supply line to the circulation pump 152). Additionally or alternatively, the water inlet valve can be positioned between the external water supply line and the sump 138 (e.g., to selectively allow water to flow from the external water supply line to sump 138). During use, the water inlet valve may be selectively controlled to open to allow the flow of water into the dishwashing appliance 100 and may be selectively controlled to close and thereby cease the flow of water into the dishwashing appliance 100. Further, the fluid circulation assembly 150 may include one or more fluid conduits or circulation piping for directing wash fluid from the circulation pump 152 to the various spray assemblies and manifolds. In an embodiment, such as that shown in FIG. 3, a primary supply conduit 154 extends from the circulation pump 152, along the rear side 112 of the tub 104 along the vertical direction V to supply wash liquid throughout the wash chamber 106.

In an embodiment, the circulation pump 152 urges or pumps wash liquid to a diverter 156 (FIG. 3). In some such embodiments, the diverter 156 is positioned within sump 138 of the dishwashing appliance 100). The diverter 156 may include a diverter disk (not shown) disposed within a diverter chamber 158 for selectively distributing the wash liquid to the spray assemblies 134, 142, or other spray manifolds or assemblies. For instance, the diverter disk may have at least one aperture configured to align with one or more outlet ports (not shown) at the top of diverter chamber 158. In this manner, the diverter disk may be selectively rotated to provide wash liquid to the desired spray device(s).

In an embodiment, the diverter 156 is configured for selectively distributing the flow of wash liquid from the circulation pump 152 to various fluid supply conduits (only some of which are illustrated in FIG. 3 for clarity). In certain embodiments, the diverter 156 includes two or more outlet ports (not shown) for supplying wash liquid to a first conduit for rotating the lower spray arm assembly 134 and a second conduit for supplying the upper spray assembly 142 (e.g., supply conduit 154). Additional embodiments may also include one or more additional conduits, e.g., a third conduit for spraying an auxiliary rack such as a silverware rack, etc.

In some embodiments, a supply conduit 154 is used to supply wash liquid to one or more spray assemblies (e.g., to upper spray assembly 142). It should be appreciated, however, that according to alternative embodiments, any other suitable plumbing configuration may be used to supply wash liquid throughout the various spray manifolds and assemblies described herein. For instance, according to another embodiment, the supply conduit 154 could be used to provide wash liquid to the lower spray arm assembly 134 and a dedicated secondary supply conduit (not shown) could be utilized to provide wash liquid to the upper spray assembly 142. Other plumbing configurations may be used for providing wash liquid to the various spray devices and manifolds at any location within the dishwashing appliance 100.

Each spray assembly 134 and 142, or other spray device as may be included in the dishwashing appliance 100, may include an arrangement of discharge ports or orifices for directing wash liquid received from the circulation pump 152 onto dishes or other articles located in the wash chamber 106. The arrangement of the discharge ports, also referred to as jets, apertures, or orifices, may provide a rotational force by virtue of wash liquid flowing through the discharge ports. Alternatively, the spray assemblies 134, 142 may be motor-driven, or may operate using any other suitable drive mechanism. Spray manifolds and assemblies may also be stationary. The resultant movement of the spray assemblies 134, 142 and the spray from fixed manifolds provides coverage of dishes and other dishwasher contents with a washing spray. Other configurations of spray assemblies may be used as well. For instance, the dishwashing appliance 100 may have additional spray assemblies for cleaning silverware, for scouring casserole dishes, for spraying pots and pans, for cleaning bottles, etc.

Drainage of soiled wash liquid within the sump 138 may be provided, for instance, by a drain pump 168 (e.g., during or as part of a drain phase). In particular, wash liquid may exit the sump 138 through a drain outlet 167 and may flow through a drain conduit or directly to the drain pump 168. Thus, the drain pump 168 is downstream of the sump 138 and facilitates drainage of the soiled wash liquid by urging or pumping the wash liquid to a drain line external to dishwashing appliance 100.

Figure 4:
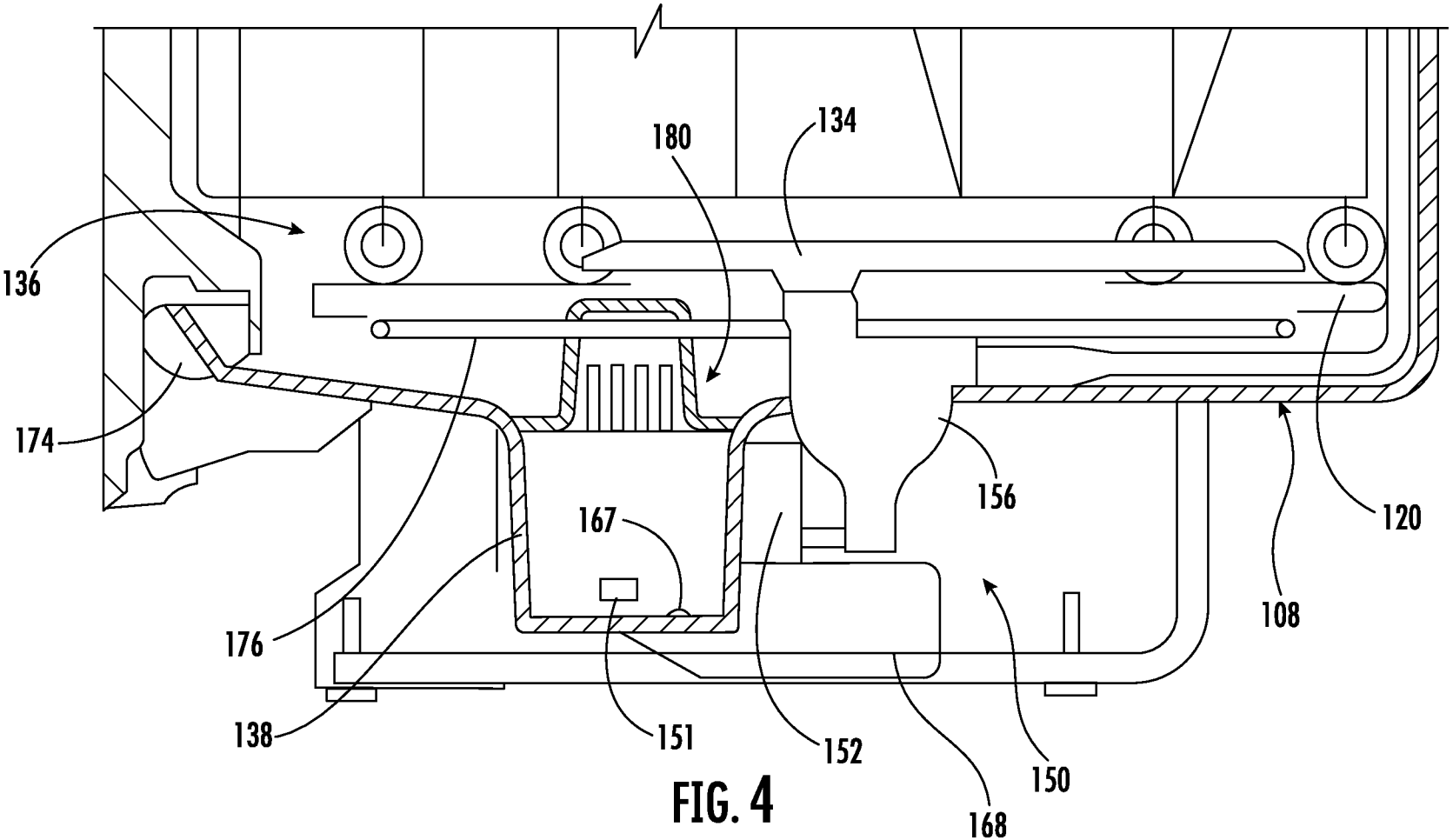
FIG. 4 provides an enlarged view of a portion of the exemplary dishwashing appliance of FIG. 3.

In some embodiments, as shown in FIGS. 3 and 4, a filter assembly 180 may be provided, e.g., in the sump 138 and/or at a top entrance into the sump 138, e.g., to filter fluid to the circulation assembly 150 and/or the drain pump 168. Generally, the filter assembly 180 removes soiled particles from the liquid that flows to the sump 138 from the wash chamber 106 during operation of the dishwashing appliance 100. In an embodiment, the filter assembly 180 may include a filter basket having both a first filter (also referred to as a "coarse filter") and a second filter (also referred to as a "fine filter").

Although a separate circulation pump 152 and drain pump 168 are described herein, it is understood that other suitable pump configurations (e.g., using only a single pump for both recirculation and draining) may be provided.

The dishwashing appliance 100 may further include a heating element 176, such as a resistance heating element, positioned in or near the sump 138. For example, the heating element 176 may be positioned "near" the sump 138 in that the heating element 176 is disposed above the sump 138 and within the lower region 136 of the wash chamber 106, such as below the lower spray arm 134 and/or below the lower rack assembly 122. The heating element 176 may be positioned and configured to heat liquid in the sump 138, such as for a heated wash phase, and/or to heat air within the wash chamber 106, such as for drying articles during a dry phase.

The dishwashing appliance 100 may also include ventilation features, e.g., to promote improved, e.g., more rapid, drying of articles therein after the wash and rinse phases. For example, one or more vents 166 may be provided in the tub 104 for introducing relatively dry air from outside of the tub 104 into the wash chamber 106 and/or for removing relatively humid air from the wash chamber 106 to the outside of the tub 104. In some embodiments, a fan 172 may be provided. The fan 172 may be operable to urge air through the wash chamber 106, such as to promote air circulation and/or ventilation within and through the wash chamber. Such air movement may increase the rate of evaporation of moisture from articles in the wash chamber 106 after a wash and/or rinse phase.

In certain embodiments, the dishwashing appliance 100 includes a controller 160 configured to regulate operation of dishwashing appliance 100 (e.g., initiate one or more wash operations). The controller 160 may include one or more memory devices and one or more microprocessors, such as general or special purpose microprocessors operable to execute programming instructions or micro-control code associated with a wash operation or wash cycle that may include a pre-wash phase, a wash phase, a rinse phase, a drain phase, and/or a dry phase. The memory may represent random access memory such as DRAM or read only memory such as ROM or FLASH. In some embodiments, the processor executes programming instructions stored in memory. The memory may be a separate component from the processor or may be included onboard within the processor. Alternatively, the controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

The controller 160 may be positioned in a variety of locations throughout dishwashing appliance 100. In an embodiment, the controller 160 is located within a control panel area 162 of door 116 (FIG. 1). Input/output ("I/O") signals may be routed between the control system and various operational components of the dishwashing appliance 100 along wiring harnesses that may be routed through the bottom of door 116. Typically, the controller 160 includes or is operatively coupled to a user interface panel 164 through which a user may select various operational features and modes and monitor progress of the dishwashing appliance 100. In some embodiments, user interface panel 164 includes a general purpose I/O ("GPIO") device or functional block.

In an embodiment, the user interface panel 164 includes input components, such as one or more of a variety of electrical, mechanical or electro-mechanical input devices including rotary dials and/or push buttons. In further embodiments, user interface panel 164 includes a display component, such as a digital or analog display device designed to provide operational feedback to a user. When assembled, the user interface panel 164 may be in operative communication with the controller 160 via one or more signal lines or shared communication busses.

It should be appreciated that the present disclosure is not limited to any particular style, model, or configuration of dishwashing appliance 100. The embodiments depicted in FIGS. 1 through 4 are for illustrative purposes only. For instance, different locations may be provided for the control panel area 162 (e.g., on the front of the door 116 as illustrated in FIG. 1 or on the top of the door 116 as illustrated in FIG. 2, or other locations as well), different configurations may be provided for rack assemblies 122, 126, different spray assemblies 134, 142 and spray manifold configurations may be used, different sensors may be used, and other differences may be applied while remaining within the scope of the present disclosure.

Figure 5:
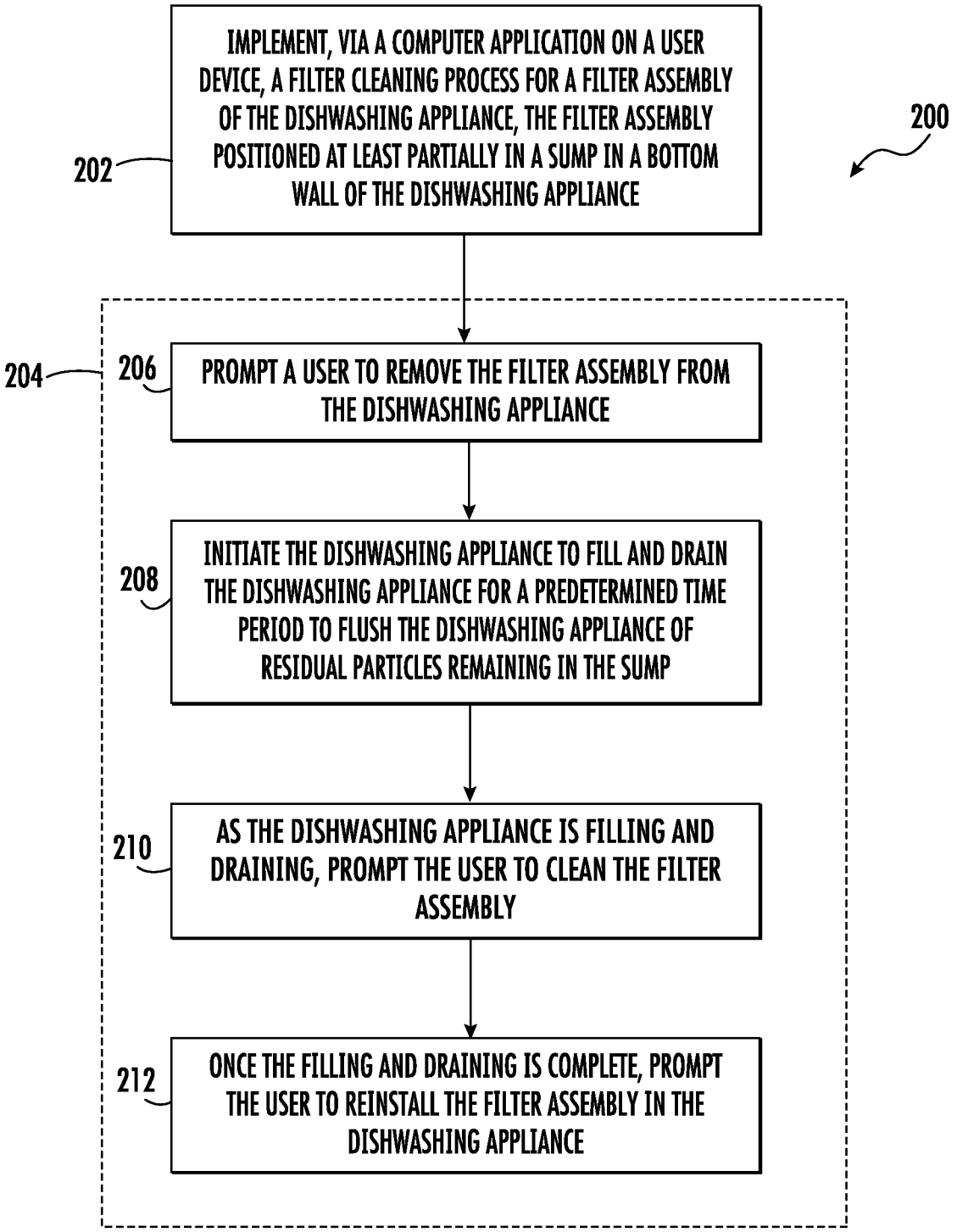
FIG. 5 provides a flow diagram of an embodiment of a method for improving cleaning performance of a dishwashing appliance according to the present disclosure.

Referring now to FIG. 5, embodiments of the present disclosure may also include methods of improving cleaning performance of a dishwashing appliance, such as the exemplary method 200 illustrated in FIG. 5. For example, such methods may be used with the dishwashing appliance 100 but are not limited to this particular dishwashing appliance. Accordingly, it is to be understood that reference numerals for the dishwashing appliance 100 and components thereof are included in the description of the method 200 solely for purposes of illustration and by way of example only.

As shown at (202), the method 200 includes implementing, via a computer application, a filter cleaning process 204 for a filter assembly of the dishwashing appliance. As mentioned, the filter assembly may be filter assembly 180 that is positioned at least partially in the sump 138 of the dishwashing appliance. As shown at (206), the filter cleaning process 204 includes prompting a user to remove the filter assembly from the dishwashing appliance. As shown at (208), the filter cleaning process includes initiating the dishwashing appliance to fill and drain the dishwashing appliance for a predetermined time period to flush the dishwashing appliance of residual particles remaining in the sump. As the dishwashing appliance is filling and draining, as shown at (210), the filter cleaning process includes prompting the user to clean the filter assembly. Once the filling and draining is complete, as shown at (212), the method 200 includes prompting the user to reinstall the filter assembly in the dishwashing appliance.

The method 200 of FIG. 5 can be better understood with respect to FIGS. 6A-6F. In particular, FIGS. 6A-6F illustrate various screenshots of a user interface 300, such as a user interface on a mobile device, implementing a computer application 302 according to the present disclosure. It should be understood that the user interface may be any suitable interface that is part of the dishwashing appliance 100 and/or remote from the dishwashing appliance 100. As shown particularly in FIG. 6A, the computer application 302 is displaying a control panel 304 that provides general information relating to operation of the dishwashing appliance 100. For example, as shown, the computer application 302 provides a status 306 of the dishwashing appliance 100 (e.g., Off) and of the filter assembly 180 to the user. In the illustrated embodiment, for example, the user can select to remotely start the dishwashing appliance 100 if so desired. In addition, as shown, the status of the filter assembly 180 is "Needs Cleaning" to indicate to the user that the filter assembly 180 needs to be cleaned. Other statuses of the filter assembly 180 may also be displayed, such as "Clean", "Clogged", and so on. In such embodiments, the computer application 302 may determine that the filter assembly 180 is clogged or otherwise needs to be cleaned via an algorithm of the computer application 302 or the controller 160 of the dishwashing appliance 100.

Furthermore, in addition to displaying the status of the filter assembly 180 via the control panel 304, the status may also be displayed to the user via a push notification. Various other features may also be displayed to the user via the control panel 304, such as lock control 310, and usage data 312. In addition, as shown, the user can select between multiple tabs 314 (e.g., home, control, cycles, extras, service, etc.).

Accordingly, as shown, in response to the status being indicative of the filter assembly 180 needing to be cleaned, the user may select to "Perform a Filter Cleaning Cycle" as needed based on the status displayed. In addition, in an embodiment, the computer application 302 may display a notification informing the user of one or more outcomes associated with failure to clean the filter assembly 180, so as to encourage the user to implement the filter cleaning process. Thus, in an embodiment, when the user selects to initiate the filter cleaning process, the computer application 302 receives instructions to implement the filter cleaning process for the filter assembly 180 of the dishwashing appliance 100. Upon receiving the instructions, the computer application 302 implements the filter cleaning process, as shown generally in FIGS. 6B-6F.

Figures 6A, 6B, 6C:
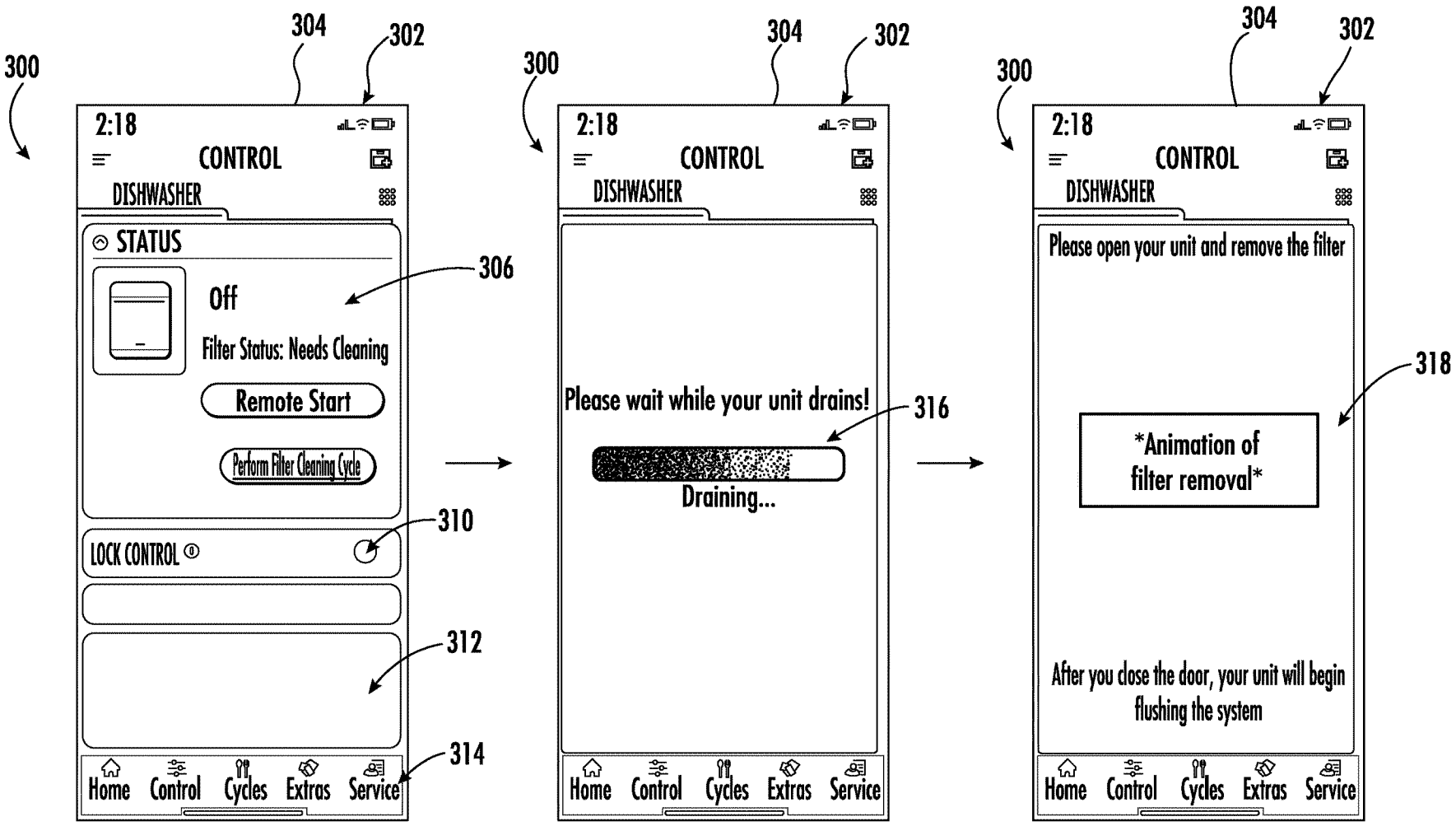
FIGS. 6A-6F provide various screenshots of an embodiment of a user interface, such as a mobile device, implementing a computer application configured to run a filter cleaning process for a dishwashing appliance according to the present disclosure.

More specifically, in an embodiment, as shown in FIG. 6B, the filter cleaning process includes initiating the dishwashing appliance 100 to drain residual water remaining in the tub 104 of the dishwashing appliance 100. Further, as shown, in an embodiment, the control panel 304 may indicate to the user to wait while the dishwashing appliance 100 drains. Moreover, as shown, the control panel 304 may also display a status bar 316 indicating that draining is in process and to give the user an estimate of time to completion.

Once drained, as shown in FIG. 6C, the control panel 304 may prompt the user to open the dishwashing appliance 100 and remove the filter assembly 180. In an embodiment, for example, the control panel 304 may display instructions 318 (e.g., words or animation) to user indicating how to remove the filter assembly 180 from the dishwashing appliance 100. After removal of the filter assembly 180, the control panel 304 may also prompt the user to ensure the door 116 of the dishwashing appliance 100 is closed. Thus, in an embodiment, the control panel 304 will prevent the filter cleaning process from continuing forward unless the door 116 is securely closed.

Figures 6D, 6E, 6F:
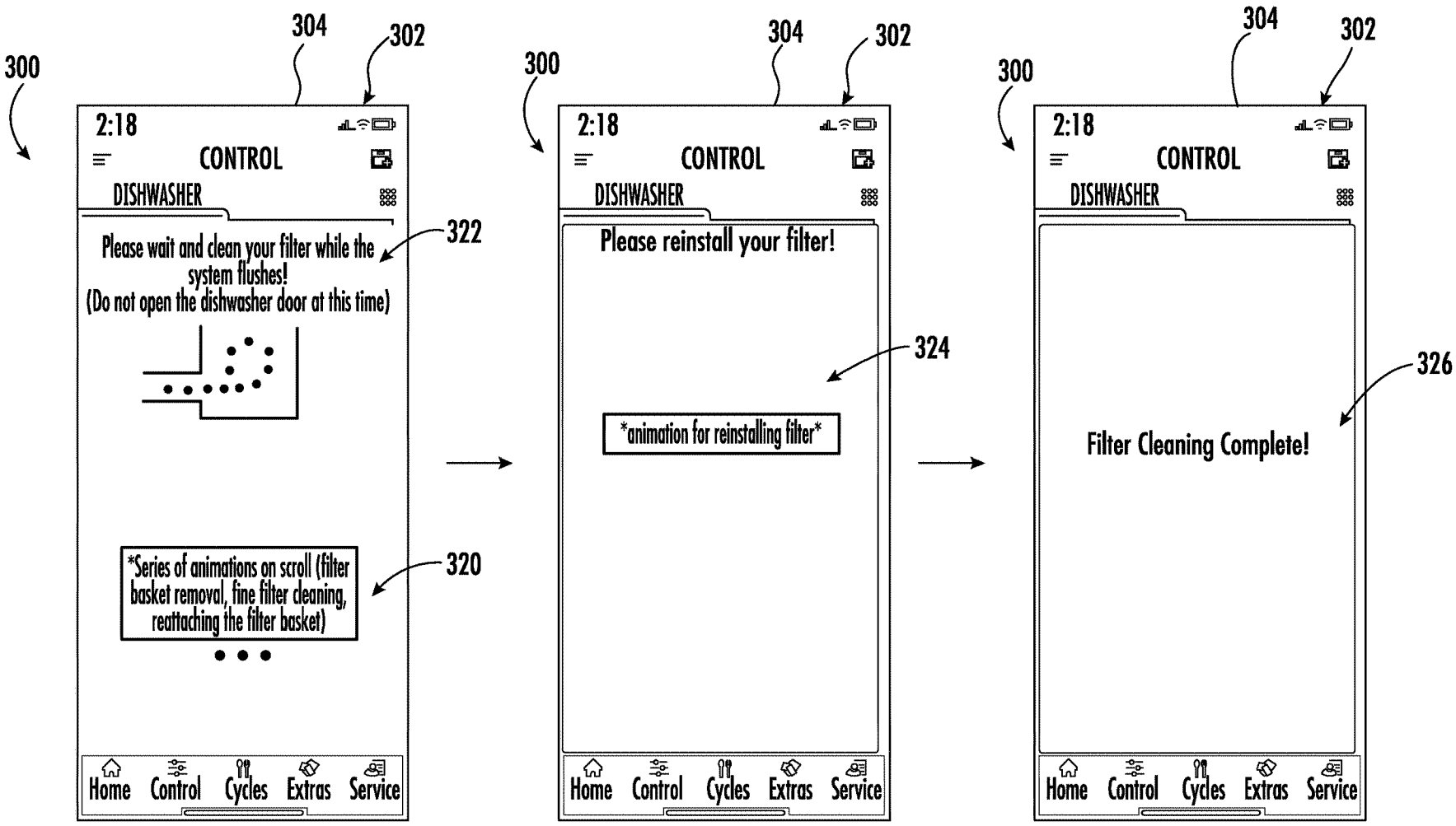

Referring now to FIG. 6D, the filter cleaning process includes initiating the dishwashing appliance 100 to fill and drain the dishwashing appliance 100 for a predetermined time period to flush the dishwashing appliance 100 of residual particles remaining in the sump 138. For example, in an embodiment, initiating the dishwashing appliance 100 to fill and drain the dishwashing appliance 100 for the predetermined time period to flush the dishwashing appliance 100 of residual particles remaining in the sump may include initiating a series of fills and drains to remove the residual particles, such as those particles stuck to a side of the sump below a recirculation line.

Moreover, and still referring to FIG. 6D, as the dishwashing appliance 100 is filling and draining, the computer application 302 is further configured to prompt the user to clean the filter assembly 180. For example, as shown, the computer application 302 may display one or more instructions 320 (e.g., words or animation) for cleaning the filter assembly 180 in a guided (e.g., step-by-step) manner. More specifically, in an embodiment, the filter assembly 180 may include a filter basket, a fine filter, and a coarse filter. In such embodiments, for example, the instruction(s) 318 may include how to remove the filter basket, how to clean the fine filter, how to clean the coarse filter, etc., as well as any other instructions relating to a particular filter assembly 180 and/or dishwashing appliance 100. In additional embodiments, as shown, the control panel 304 may also include various warnings 322 to the user, such as instructing the user to wait while the dishwashing appliance is filling and draining and refrain from opening the door 116 during filling and draining.

Referring now to FIG. 6E, the filter cleaning process includes prompting the user to reinstall the filter assembly 180 in the dishwashing appliance 100. For example, as shown, the computer application 302 may display one or more instructions 324 (e.g., words or animation) for reinstalling the filter assembly 180 in a guided (e.g., step-by-step) manner.

Referring now to FIG. 6F, as shown at 326, the computer application 302 may then indicate to the user that the filter cleaning process is complete.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for improving cleaning performance of a dishwashing appliance, the method comprising:

implementing, via a computer application, a filter cleaning process for a filter assembly of the dishwashing appliance, the filter assembly positioned at least partially in a sump in a bottom wall of the dishwashing appliance, the filter cleaning process comprising:

prompting a user to remove the filter assembly from the dishwashing appliance;

prompting the user to clean the filter assembly;

initiating the dishwashing appliance to fill and drain the dishwashing appliance for a predetermined time period to flush the dishwashing appliance of residual particles remaining in the sump; and once the filling and draining is complete, prompting the user to reinstall the filter assembly in the dishwashing appliance.

2. The method of claim 1, further comprising:

providing, via the computer application, a status of the filter assembly to the user.

3. The method of claim 1, wherein the filter cleaning process further comprises initiating the dishwashing appliance to drain residual water remaining in a tub of the dishwashing appliance before prompting the user to remove the filter assembly from the dishwashing appliance.

4. The method of claim 1, wherein the filter cleaning process further comprises prompting the user to ensure a door of the dishwashing appliance is closed.

5. The method of claim 1, further comprising determining that the filter assembly is clogged via an algorithm of the computer application or a controller of the dishwashing appliance.

6. The method of claim 1, further comprising, as the dishwashing appliance is filling and draining, prompting the user to clean the filter assembly.

7. The method of claim 1, wherein prompting the user to reinstall the filter assembly in the dishwashing appliance further comprises displaying, via the computer application, one or more instructions for reinstalling the filter assembly in a guided manner.

8. The method of claim 1, wherein the filter cleaning process further comprises displaying at least one of instructions or animation instructing the user to wait while the dishwashing appliance is filling and draining.

9. The method of claim 1, further comprising displaying, via the computer application, a notification informing the user of one or more outcomes associated with failure to clean the filter assembly.

10. The method of claim 1, wherein initiating the dishwashing appliance to fill and drain the dishwashing appliance for the predetermined time period to flush the dishwashing appliance of residual particles remaining in the sump further comprises:

initiating a series of fills and drains to remove the residual particles, the residual particles comprising particles stuck to a side of the sump below a recirculation line.

11. The method of claim 2, wherein the status is provided via at least one of a control panel of the computer application or a push notification.

12. The method of claim 2, further comprising:

in response to the status being indicative of the filter assembly needing to be cleaned, receiving, via the computer application, instructions to implement the filter cleaning process for the filter assembly of the dishwashing appliance; and upon receiving the instructions, implementing, via the computer application, the filter cleaning process.

13. The method of claim 6, wherein prompting the user to clean the filter assembly further comprises displaying, via the computer application, one or more instructions for cleaning the filter assembly in a guided manner.

14. The method of claim 13, wherein the filter assembly comprises a filter basket, a fine filter, and a coarse filter, and wherein the one or more instructions comprise at least one of how to remove the filter basket, how to clean the fine filter, or how to clean the coarse filter.

* * * * *